US008905876B2

(12) United States Patent
Guenther et al.

(10) Patent No.: US 8,905,876 B2
(45) **Date of Patent: *Dec. 9, 2014**

(54) GAME BALL COVER WITH IMPROVED STRIPES

(71) Applicant: Wilson Sporting Goods Co., Chicago, IL (US)

(72) Inventors: Douglas G. Guenther, Wheaton, IL (US); Kevin L. Krysiak, Chicago, IL (US); Ming Hsin Lee, Taipei (TW)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/866,196

(22) Filed: Apr. 19, 2013

(65) Prior Publication Data

US 2013/0231206 A1 Sep. 5, 2013

Related U.S. Application Data

(63) Continuation of application No. 12/220,569, filed on Jul. 25, 2008, now Pat. No. 8,460,135, and a continuation of application No. 11/404,986, filed on Apr. 14, 2006, now abandoned, and a continuation-in-part of application No. 10/325,421, filed on Dec. 20, 2002, now Pat. No. 7,029,407.

(51) Int. Cl.
*A63B 41/08* (2006.01)
*A63B 43/00* (2006.01)

(52) U.S. Cl.
CPC ..... *A63B 41/08* (2013.01); *A63B 43/008* (2013.01); *A63B 2243/0037* (2013.01); *A63B 2243/007* (2013.01)
USPC ..... 473/597; 473/599; 473/603

(58) Field of Classification Search
CPC .... A63B 41/08; A63B 43/002; A63B 43/008; A63B 2243/007
USPC ..... 473/595–597, 599, 603–605, 615, 574
See application file for complete search history.

(56) References Cited

U.S. PATENT DOCUMENTS

| | | | | |
|---|---|---|---|---|
| 1,487,658 A | | 3/1924 | Jensen | 473/599 |
| 1,559,117 A | | 10/1924 | Maynard | 273/65 |
| 1,931,429 A | | 10/1933 | Buckner et al. | 273/65 |
| 2,011,760 A | | 8/1935 | Gallinant | 473/596 |
| 2,182,053 A | | 12/1939 | Reach | 273/65 |
| 2,194,674 A | * | 3/1940 | Riddell | 473/597 |
| 2,325,128 A | | 7/1943 | Grady | 473/597 |

(Continued)

*Primary Examiner* — Steven Wong
(74) *Attorney, Agent, or Firm* — Terence P. O'Brien

(57) ABSTRACT

An American football is configured for direct contact with a user's hands and includes first and second transversely extending stripes and a plurality of cover panels. The cover panels have an outer surface formed of a first material. One of the cover panels is formed of first, second and third sub-panels. One of the side edges of the first and second stripes is fixedly coupled to one of the first and second sub-panels, respectively, and the other of the side edges of the first and second stripes is fixedly coupled to one of the second and third sub-panels, respectively. The stripes having an outer surface formed of a second material. The second material has a static coefficient of friction that is greater than the static coefficient of friction of the first material when measured in accordance with the standard test method for static coefficient of friction of ASTM D1894-01.

20 Claims, 7 Drawing Sheets

(56) References Cited

U.S. PATENT DOCUMENTS

| | | | | |
|---|---|---|---|---|
| 2,448,731 | A | 9/1948 | Park | 473/596 |
| 3,917,271 | A | 11/1975 | Lemelson et al. | 473/573 |
| 3,953,030 | A | 4/1976 | Muchnick | 273/348.4 |
| 4,515,852 | A | 5/1985 | Katabe et al. | 428/246 |
| 4,822,041 | A | 4/1989 | Molitor | 273/60 |
| 4,867,452 | A | 9/1989 | Finley | 273/65 |
| 4,869,504 | A | 9/1989 | Kralik | 273/65 |
| 4,928,962 | A | 5/1990 | Finley | 273/65 |
| 5,098,097 | A | 3/1992 | Kennedy et al. | 273/65 |
| 5,127,648 | A | 7/1992 | Mallick | 273/65 |
| 5,133,550 | A | 7/1992 | Handy | 273/65 |
| 5,183,263 | A | 2/1993 | Kuebler | 473/573 |
| 5,195,745 | A | 3/1993 | Rudell et al. | 473/573 |
| 5,228,687 | A | 7/1993 | Luecke et al. | 273/65 |
| 5,310,178 | A | 5/1994 | Walker et al. | 473/605 |
| 5,316,294 | A | 5/1994 | Turangan | 473/573 |
| 5,383,660 | A | 1/1995 | Adler et al. | 273/65 |
| 5,451,046 | A | 9/1995 | Batton | 473/470 |
| 5,570,882 | A | 11/1996 | Horkan | 473/438 |
| 5,577,724 | A | 11/1996 | Gandolfo | 273/65 |
| 5,681,233 | A | 10/1997 | Guenther et al. | 473/605 |
| 5,888,157 | A | 3/1999 | Guenther et al. | 473/604 |
| 5,931,752 | A | 8/1999 | Guenther et al. | 473/597 |
| 5,941,785 | A | 8/1999 | Bartels | 473/597 |
| 5,984,812 | A | 11/1999 | Sassak | 473/596 |
| 6,200,239 | B1 | 3/2001 | Kennedy et al. | 473/604 |
| 6,500,082 | B1 | 12/2002 | Ou | 473/599 |
| 6,514,164 | B1 * | 2/2003 | Parrett | 473/603 |
| 6,520,877 | B1 | 2/2003 | Yang | 473/604 |
| 6,634,970 | B2 | 10/2003 | Jiminez | 473/597 |
| D505,462 | S | 5/2005 | Horkan et al. | D21/712 |
| D505,463 | S | 5/2005 | Horkan et al. | D21/712 |
| 7,029,407 | B2 | 4/2006 | Lee et al. | 473/597 |
| 8,168,026 | B1 | 5/2012 | Brown et al. | 156/245 |
| 8,460,135 | B2 * | 6/2013 | Guenther et al. | 473/597 |

* cited by examiner

GAME BALL COVER WITH IMPROVED STRIPES

CROSS-REFERENCE TO RELATED APPLICATION

This application is a continuation application of U.S. patent application Ser. No. 12/220,569 filed on Jul. 25, 2008, which is a continuation application of U.S. patent application Ser. No. 11/404,986 filed on Apr. 14, 2006, now abandoned, which is a continuation-in-part of application Ser. No. 10/325,421 filed on Dec. 20, 2002, now U.S. Pat. No. 7,029,407.

FIELD OF THE INVENTION

The present invention relates generally to a game ball. In particular, the present invention relates to a game ball including a cover and at least one sheet-like member coupled to the cover wherein the static coefficient of friction of an outer surface of the sheet-like member is greater than the static coefficient of friction of an outer surface of the cover.

BACKGROUND OF THE INVENTION

Inflatable game balls, such as footballs, basketballs, volleyballs and soccer balls, are well known and typically include an inner inflatable air bladder and an outer cover. The cover can be formed of one or more cover panels. Many footballs include covers with stripes. In fact, many organized football associations, such as the National Collegiate Athletic Association ("NCAA®") and many state high school athletic associations, require stripes on their footballs. In particular, the NCAA® requires footballs to include two 1-inch white stripes that are three to three and one-quarter inches from the end of the ball and are located only on the two cover panels adjacent to the laces. The outer cover of footballs and other types of game balls also typically include trademarks, symbols and logos. The stripes, trademarks, logos and/or symbols on game balls can extend over a significant percentage of the outer surface area of the ball.

In football and basketball, as in many other sports, the gripping and tactile characteristics of the ball can considerably affect the performance of the participating players. In particular, the tactile characteristics of the outer surface of the game ball significantly affect the player's ability to catch, pass or otherwise control the ball accurately and reliably.

Football stripes are commonly applied by painting or transferring on a thin layer of paint, dye or other coating. These stripes typically have a smooth and slick outer surface which, particularly in inclement weather, can negatively affect the player's ability to catch, pass and otherwise control the ball. Many painted on or transferred on stripes are also susceptible to peeling and can wear easily. As a result, the appearance of many striped footballs overtime can be negatively affected by stripes that have partially worn or flaked off. Even premium game balls using striping material that is less slick and more durable than typical striping material, result in stripes with outer surfaces that have lower tactility than the other portions of the ball. Logos, trademarks and other symbols commonly applied to the outer surface of game balls also can have a smooth, slick outer surface and can flake or wear away easily.

Thus, there is a need for football stripes that have improved gripping and tactile characteristics, or frictional interaction with the hands of a user, without deviating or radically departing from the ball's traditional design and organized play equipment requirements. What is needed is football stripes that improve a player's ability to pass, catch or otherwise control a ball, particularly during inclement weather. Further, it would be advantageous to provide football stripes, or game ball logos, trademarks or symbols that are more durable and peel resistant. It would also be advantageous to provide game ball logos, trademarks and/or symbols, which improve the gripping and tactile characteristics of the game ball.

SUMMARY OF THE INVENTION

The present invention provides an inflatable game ball including a carcass, a cover and at least one thin member. The cover has inner and outer surfaces. The inner surface of the cover is coupled to the carcass. At least one recess is formed into the outer surface of the cover. At least one thin member is coupled to the cover at the at least one recess. The member substantially fills the recess. The member has inner and outer portions. The outer portion is formed of a highly grippable material.

According to a principal aspect of a preferred form of the invention, an inflatable football includes a cover and at least first and second stripes. The cover has an outer surface. At least first and second recesses are formed into the outer surface of the cover. The first and second stripes are coupled to the cover at the first and second recesses, respectively. The first and second stripes substantially fill the first and second recesses, respectively. Each of the first and second stripes has inner and outer portions. The outer portion of each of the first and second stripes is formed of an outer material that is compressible, resilient and tactile.

According to another preferred aspect of the invention a football includes a cover having an outer surface formed of a first material and at least first and second stripes coupled to the cover. Each of the first and second stripes has an outer surface formed of a second material. The second material has greater tactility than the first material such that the outer surface of the first and second stripes is more easily grippable than the outer surface of the cover.

According to another preferred aspect of the invention provides a method of manufacturing an inflatable game ball. The method includes the steps of obtaining a carcass, obtaining a cover having inner and outer surfaces, forming at least one recess into the outer surface of the cover, coupling the inner surface of the cover to the carcass, and substantially filling the recess with a thin member having an outer portion formed of an outer material that is compressible, resilient, and tactile.

According to another preferred aspect of the invention a game ball is configured for direct contact with a user's hands. The game ball includes a cover having an outer surface formed of a first material, and at least one sheet-like member fixedly coupled to the cover. The sheet-like member has an outer surface formed of a second material. The second material has a static coefficient of friction that is greater than the static coefficient of friction of the first material when measured in accordance with the standard test method for static coefficient of friction of ASTM D1894-01.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
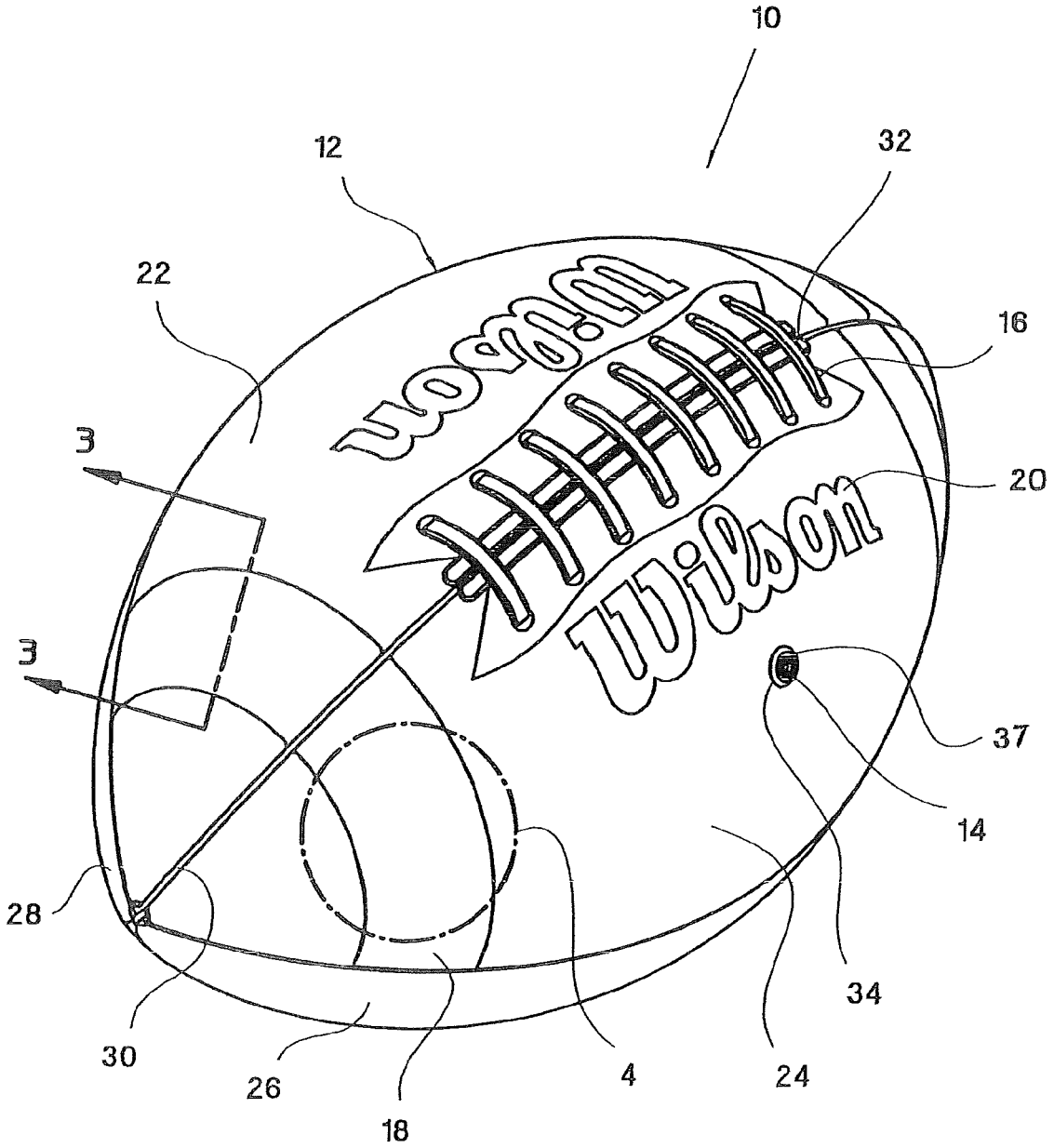
FIG. 1 is a top perspective view of an American football in accordance with a preferred embodiment of the present invention.

Referring to FIG. 1, an American football is indicated generally at 10. The football 10 is one example of an inflatable game ball. The present invention is directly applicable to other inflatable game balls, such as, for example, basketballs, volleyballs, soccer balls and rugby balls. The game balls are configured to be contacted directly by the hands of one or more users, although the game balls can also be used by one or more gloved users.

The football 10 is a generally prolate spheroidal shaped inflatable object having a major longitudinal dimension and a minor transverse dimension. The football 10 includes, a cover 12, a bladder 14, a lacing 16, four stripes 18 and a plurality of logos 20. The cover 12 is a prolate spheroidal shaped outer body preferably formed from first, second, third and fourth cover panels 22, 24, 26 and 28 that are joined to one another along longitudinal seams 30. The longitudinal seam 30 connecting the first and second cover panels 22 and 24 includes a longitudinally extending slot 32. The second cover panel 24 includes a valve aperture 34. In alternative preferred embodiments, the cover 12 can be formed of a single piece or of two, three, five or other numbers of cover panels. The cover 12 provides the ball 10 with a durable and grippable outer surface. The cover 12 is typically made of leather, rubber or a synthetic polymeric plastic material. An outer surface of the cover 12 preferably includes a pebbled texture for enhancing the grip and improving the aesthetics of the football 10.

Figure 2:
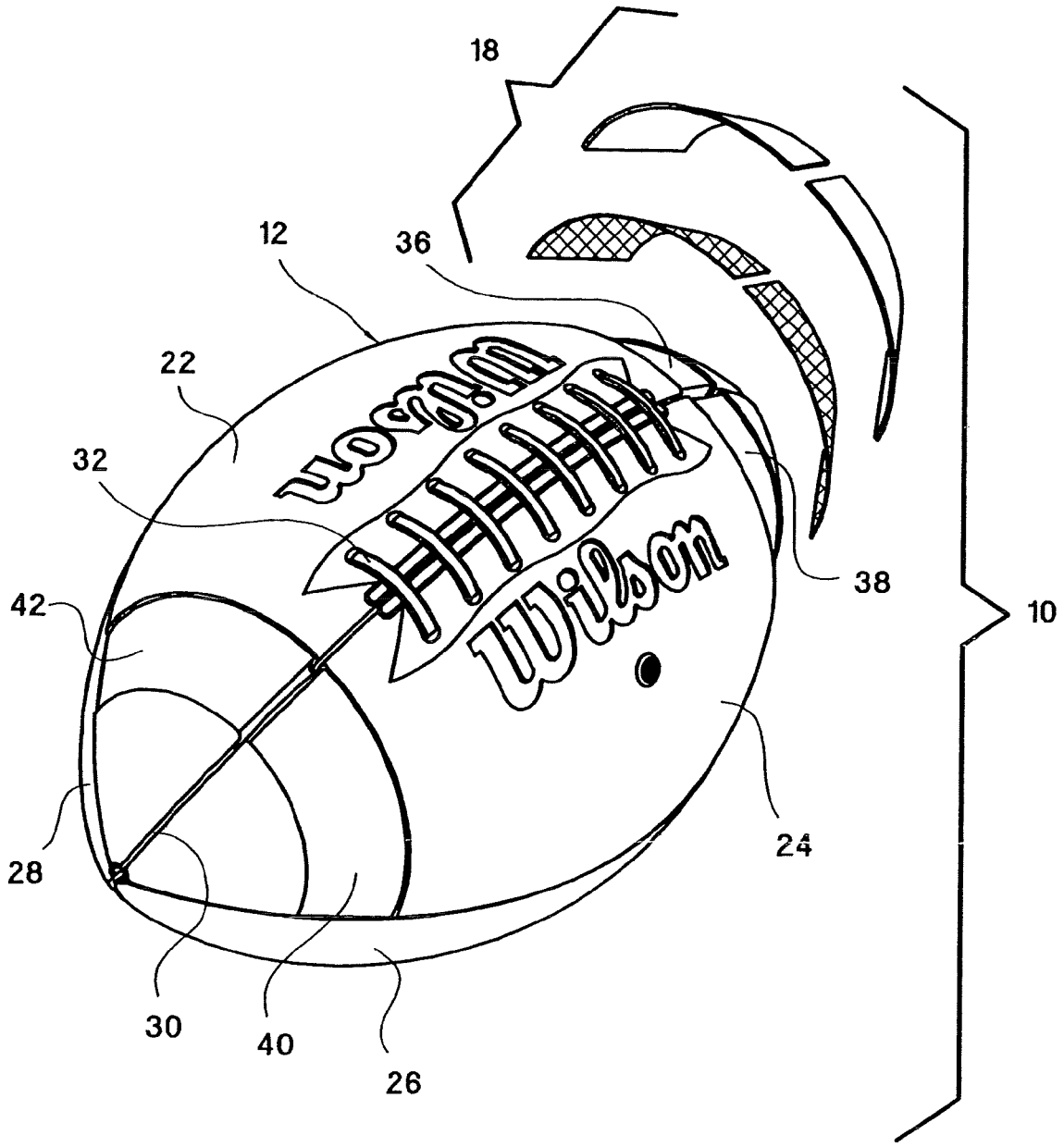
FIG. 2 is a top, partially exploded, perspective view of the football of FIG. 1.

Referring to FIG. 2, first, second, third and fourth stripe recesses 36, 38, 40 and 42 are formed into the first and second cover panels 22 and 24. The recesses 36, 38, 40 and 42 are preferably formed by embossing or pressing the cover panels 22 and 24 to produce the recesses 36, 38, 40 and 42. By embossing or pressing the cover panels to form the strip recesses, no cover panel material is removed, rather, the cover panels are simply compressed under heat and/or pressure to produce the recesses. Embossing or pressing the cover panels enables the cover panels to retain their strength, structural integrity and durability. The recesses 36, 38, 40 and 42 inwardly extend into the cover panels 22 and 24 from an outer surface of the cover panels 22 and 24. The recesses 36, 38, 40 and 42 preferably are formed with a depth within the range of 0.2 to 2.0 millimeters. In a particularly preferred embodiment, the depth of the recesses 36, 38, 40 and 42 is within the range of 0.5 to 1.0 millimeters. In yet another particularly preferred embodiment, the recesses have a depth within the range of 0.65 to 0.8 millimeters.

The stripe recesses 36, 38, 40 and 42 can be positioned at any position about the cover panels and can have any width or length dimension. Preferably, the position, width and length of the stripe recesses 36, 38, 40 and 42 are located and sized in accordance with stripe requirements of a particular athletic association requirement. For example, the NCAA® requires two 1-inch white stripes that are three to three and one-quarter inches from the end of the ball and are located only on the two cover panels adjacent to the laces. Therefore, the stripe recesses can be positioned and sized to correspond with the NCAA® stripe requirements. Alternatively, the stripe recesses can be positioned and sized to match the stripe requirements of other organizations, such as state high school athletic associations.

In alternative preferred embodiments, the stripe recesses can be formed on any one or more of the cover panels 22, 24, 26 and 28. In another alternative embodiment, the stripe recesses can be formed by milling, stripping or otherwise removing material from the outer surface of the cover panel to form the recess. In another alternative preferred embodiment, the cover, including the cover panels, can be formed without recesses.

Referring to FIG. 1, the bladder 14 is an inflatable air tube preferably having a prolate spheroidal shape. The bladder 14 is inserted into the cover 12 through the slot 32. The bladder 14 includes a valve 37 that extends through the valve aperture 34 of the cover 12 for access by a user.

The lacing 16 is used to secure the first and second cover panels 22 and 24 and to close the slot 32. The lacing 6 also provides raised surfaces for a player to contact when passing, catching or holding onto the football 10.

Referring to FIG. 2, the stripe 18 is an elongate thin member sized and positioned to substantially fill one of the stripe recesses 36, 38, 40 and 42. The stripes 18 are also preferably positioned and sized to match the position and size of the stripe recesses. In a particularly preferred embodiment, the stripes 18 are sized to meet a specific association or organization requirements for stripes, such as, for example, the NCAA® and state high school associations. The stripes 18 are preferably formed with a thickness within the range of 0.2 to 2.0 millimeters. In a particularly preferred embodiment, the thickness of the stripes is within the range of 0.5 to 1.0 millimeters. In yet another particularly preferred embodiment, the thickness of the strips 18 is within the range of 0.65 to 0.8 millimeters. In another preferred embodiment, the thickness of the stripe 18 can be selected to substantially fill and slightly outwardly extend from cover panel. In another alternative preferred embodiment, the stripe 18 is applied directly to the outer surface of the cover or cover and of the football without a recess. In this embodiment, the stripe can outwardly extend front the outer surface of the cover or cover panel by a predetermined amount, such as, for example, 0.2 to 2.0 mm.

Each stripe 18 is permanently (not removeably) attached to one of the cover panels 22 and 24. Preferably, the stripe is attached to one of the cover panels through adhesive bonding, thermal bonding, chemical bonding, stitching, sewing, press-fitting, and combinations thereof. In a particularly preferred embodiment, the stripe 18 is attached to the cover panel by stitching, or sewing, and adhesive bonding. An adhesive is applied to one or both of the inner surface of the stripe 18 and the exposed surface of the stripe recess. The stripe 18 is stitched or sewn at each end adjacent to the respective longitudinal seam 30. In one preferred embodiment, the stripe 18 is laid over a portion of the cover panel and stitched to the cover panel. Referring to FIG. 3A, in another alternative preferred embodiment, the cover panel 22 is formed of two or more sub-panels 23 and 25. One side edge 27 of the stripe 18 is stitched to an edge 29 of one of the sub-panels 23 and another side edge 31 of the stripe 18 is stitched to an edge 33 of another sub-panel 25. In this alternative preferred embodiment, the stripe 18 does not fully overlap the cover 12 or cover panel 22, rather the stripe 18 serves as a portion of the cover panel 22. In this embodiment, stitching of the edges is preferred, but the stripe and cover sub-panels can also be coupled through other conventional means, such as, for example, bonding, welting, adhesives, etc. In an alternative preferred embodiment, the stripe 18 can be applied to the stripe recess in a liquid state and then allowed to cure.

In a preferred embodiment, the stripe 18 includes outer and inner portions 44 and 46. The outer portion 44 is formed of a compressible, resilient and tactile (as in tacky) material, preferably, a polyurethane. In alternative preferred embodiments, the outer portion 44 can be formed of other materials, such as, for example, a polyvinylchloride, a rubber, a leather, a synthetic leather, an elastomer and combinations thereof. The stripe 18 is not formed of a hook and/or loop material, or a loose sand-like material that is glued to the cover 12. The outer portion 44 is preferably formed in a white color. Alternatively, the outer portion 44 can be formed in any other color or color combination. In a preferred embodiment, the tactile characteristics and the frictional interaction of the outer portion 44 of the stripe 18 with the hands of a user are greater than or equal to the tactile characteristics and frictional interaction of outer surface of the cover 12 or the cover panels 22, 24, 26 and 28 with the hands of a user. In one particularly preferred embodiment, the outer portion 44 of the stripe 18 is formed of a polyurethane or other highly grippable material and is used on a ball 10 having a leather, composite leather, or a synthetic leather material with less tactility (or tackiness).

The inner portion 46 of the stripe 18 is a backing layer configured to strengthen and facilitate attachment of the stripe to the cover 12. The inner portion 46 is fixedly connected to the outer portion through bonding, impregnation, or other conventional means. The inner portion 46 is preferably formed of a strong, tear resistant material, such as, a woven or unwoven fabric. The fabric of the inner portion 46 can be impregnated with a polymer, such as a latex.

The outer portion 44 of the stripe 18 improves the overall feel of the stripes and the ball, and increases the frictional interaction between the stripe 18 and the hands of the player. This increased frictional interaction enables the stripe 18 to improve or increase the gripability or tactility of the football 10, thereby improving a player's ability to pass, catch, hold on to, and otherwise control the ball 10, particularly in inclement weather. The stripe 18 of the present invention eliminates the smooth and slick outer surface of the stripe present on many existing balls. The stripe 18 is also more durable, more wear resistant and less susceptible to peeling than conventional football stripes. The stripe 18 is configured to withstand the stresses encountered during normal use without peeling or significantly wearing, and to improve the overall feel of the stripe 18 and the ball 10 to the user. Additionally, the stripe 18 of the present invention improves the feel and playability of the ball without deviating from the traditional look of a game ball or the football requirements of athletic associations.

Figure 3:
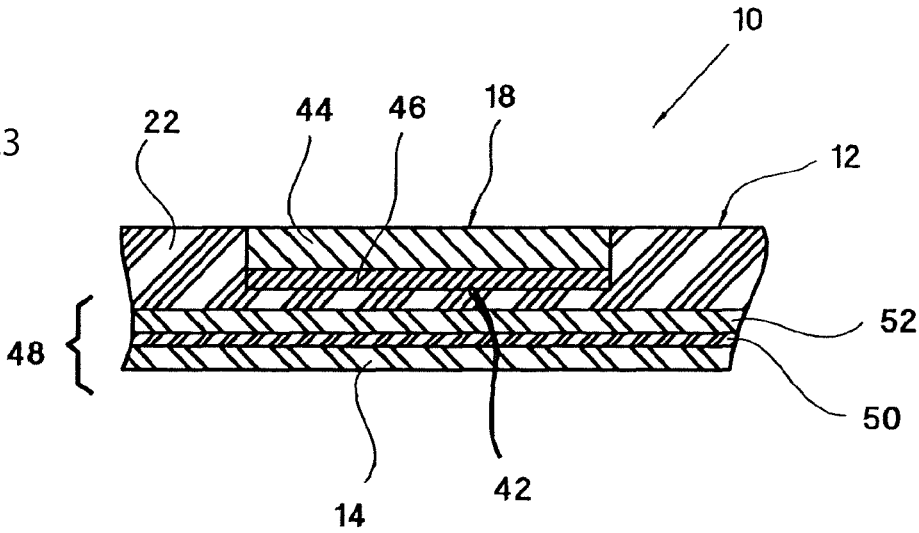
FIG. 3 is a sectional view of the football taken along lines 3-3 of FIG. 1.
Figure 3A:
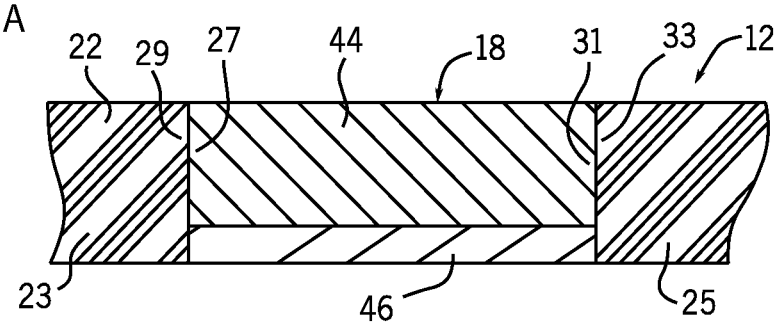
FIG. 3A is a sectional view of the cover of the football taken along lines 3-3 of FIG. 1 in accordance with an alternative preferred embodiment of the present invention.

FIG. 3 illustrates the football 10 in greater detail. The football 10 is a multi-layered structure preferably including a carcass 48 and the cover 12. In one preferred embodiment, the carcass 48 includes the bladder 14, a windings layer 50 and a padding layer 52. The carcass 48 enables the football 10 to retain its desired shape, and a predetermined amount of air thereby achieving the desired firmness to the football 10. The carcass 48 also improves the strength, reliability and feel of the ball 10. In alternative preferred embodiments, the carcass can include other combinations of materials and layers. The stripe recess 42 (or stripe recesses 36, 38 or 40) preferably has a U-shaped cross-section for receiving the stripe 18. In alternative, preferred embodiments, the stripe recess can take other cross-sectional shapes, such as for example, polygonal, arcuate, irregular and combinations thereof.

The stripe 18 substantially fills the stripe recess 42. In an alternative preferred embodiment, the stripe 18 can partially fill the recess thereby providing a recessed outer surface. In another alternative preferred embodiment, the stripe 18 can fill the recess and slightly outwardly extend from the recess thereby providing a raised stripe look and feel to the ball.

Figure 4:
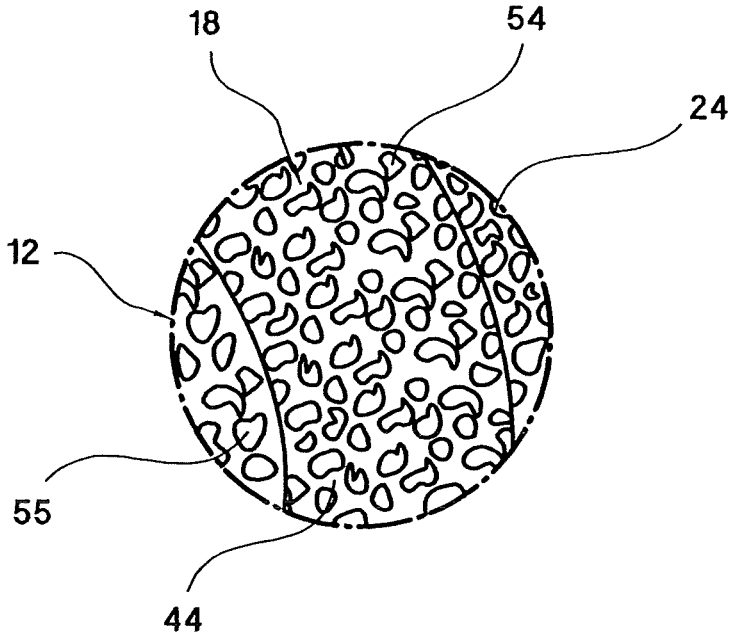
FIG. 4 is a top view of a portion of the outer surface of the football within the circle 4 of FIG. 1.
Figure 5:
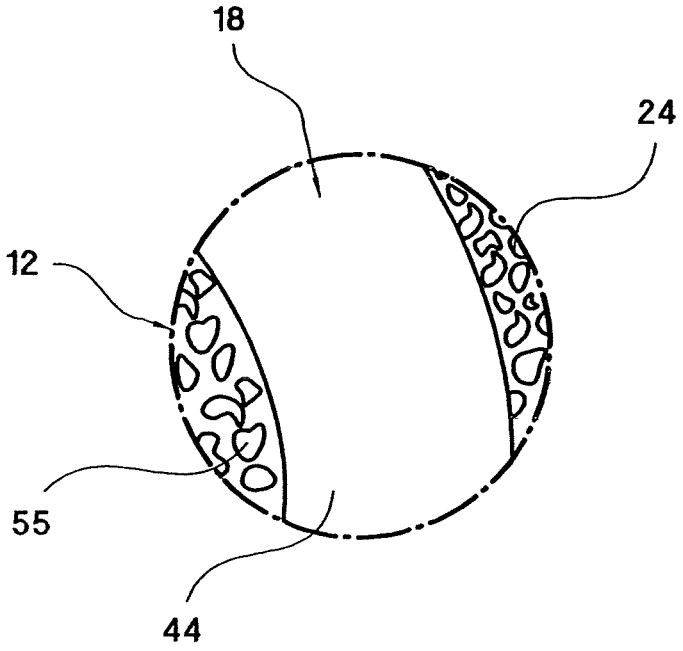
FIG. 5 is a top view of a portion of the outer surface of a football in accordance with an alternative preferred embodiment of the present invention.

FIG. 4 illustrates the cover 12 and the stripe 18 in greater detail. In a preferred embodiment, the outer surface of the outer portion 44 of the stripe 18 has a pebbled texture including a plurality of pebble-like projections 54. The outer surface of the cover 12 also preferably includes a pebbled texture and a plurality of pebble-like projections 55, which are substantially similar to the pebble-like projections 54 of the stripe 18. The pebble-like projections 54 provide the outer surface of the stripe 18 with a pebbled texture that is substantially similar to the grip enhancing pebbled outer surface present on the cover 12 of conventional footballs and basketballs. The pebble-like projections 54 are preferably convex, rounded and spaced apart from one another. The pebble-like projections 54 further improve the player's ability to grip the football 10. In an alternative preferred embodiment, the outer surface 52 of the stripe 18 can include a plurality of concave pebble-like projections. Referring to FIG. 5, in an alternative preferred embodiment, the outer surface of the stripe 18 can be generally smooth and free of pebble-like projections. In other embodiments, the outer surface 52 can be cross-hatched, grainy, grooved or otherwise irregular to roughen the texture of the outer surface of the stripe 18.

Figure 6:
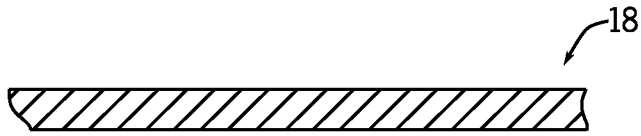
FIG. 6 is a sectional view of a football stripe in accordance with an alternative preferred embodiment of the present invention.
Figure 7:
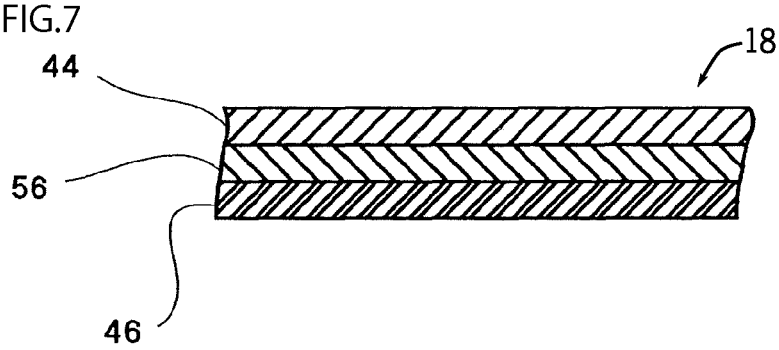
FIG. 7 is a sectional view of a football stripe in accordance with another alternative preferred embodiment of the present invention.

Referring to FIGS. 6 and 7, alternative preferred embodiments of the stripe 18 are illustrated. FIG. 6 illustrates one preferred alternative embodiment, wherein the stripe 18 is formed of one continuous material. The material is substantially similar to the materials used for the outer portion 44 of the stripe 18 discussed above. Referring to FIG. 7, another alternative preferred embodiment of the stripe 18 is illustrated. The stripe 18 can be multi-layered with the outer and inner portions 44 and 46, as discussed above separated by an intermediate layer 56. The intermediate layer can be formed of any suitable material. The material of the intermediate layer 56 can vary from one ball to the next depending upon the desired characteristics of the stripe (compressibility, durability, softness, etc.).

Figure 8:
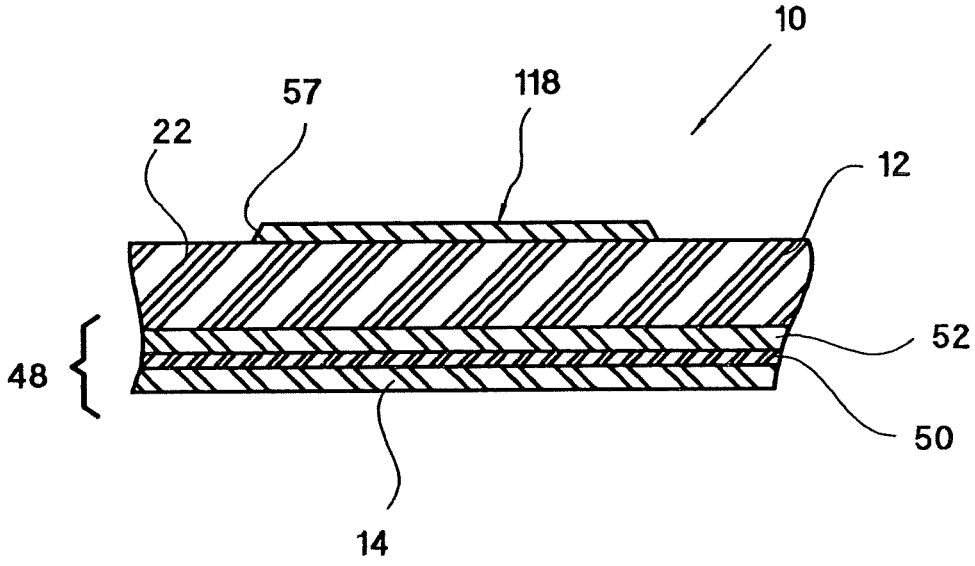
FIG. 8 is a sectional view of a football in accordance with another alternative preferred embodiment of the present invention.

Referring to FIG. 8, an alternative preferred embodiment of the stripe 18 applied to the cover panel 22 is illustrated. In this embodiment, a stripe 18 is attached directly to the outer surface of a portion of the cover 12 or one of the cover panels 22, 24, 26 or 28. The stripe 118 is substantially similar to the stripe 18 described above. The stripe 118 can be attached to the cover and cover panel by chemical, thermal, or mechanical bonding, stitching, sewing or other conventional means. The stripe 118 can be formed of the same materials as the stripe 18. The stripe 118 is shown as being formed of a single continuous material, alternatively, the stripe 118 can include a backing or multiple layers. The outer surface of the stripe 118 can be pebbled, smooth or have other outer surface configurations such as those described above for the stripe 18. The portion of the cover 12 or cover panel contacting the stripe is not recessed. As such the stripe 118 outwardly extends from outer surface of the cover 12 or cover panel 22. Each side of the stripe 118 preferably includes a tapered edge 57 in order to eliminate a shape raised corner edge.

The outer surface of the stripe 118 is preferably made of a material that is more tactile (or tacky), or has greater tactility (or tackiness), than the material the outer surface of the cover 12 or cover panel. The outer surface of the stripe 118 also has a greater frictional interaction with the hands of a user than the outer surface of the cover 12. In other words, the material of the outer surface of stripe 118 is preferably formed of a material that is more grippable than the material of the outer surface of the cover 12 or the cover panel. For example, the cover panel or cover 12 can be formed of a leather and the stripe 118 can be formed of a polyurethane. The stripes 118 are preferably formed with a thickness within the range of 0.2 to 2.0 millimeters. In a particularly preferred embodiment, the thickness of the stripes 118 is within the range of 0.5 to 1.0 millimeters. In yet another particularly preferred embodiment, the thickness of the stripes 118 is within the range of 0.65 to 0.8 millimeters.

Figure 9:
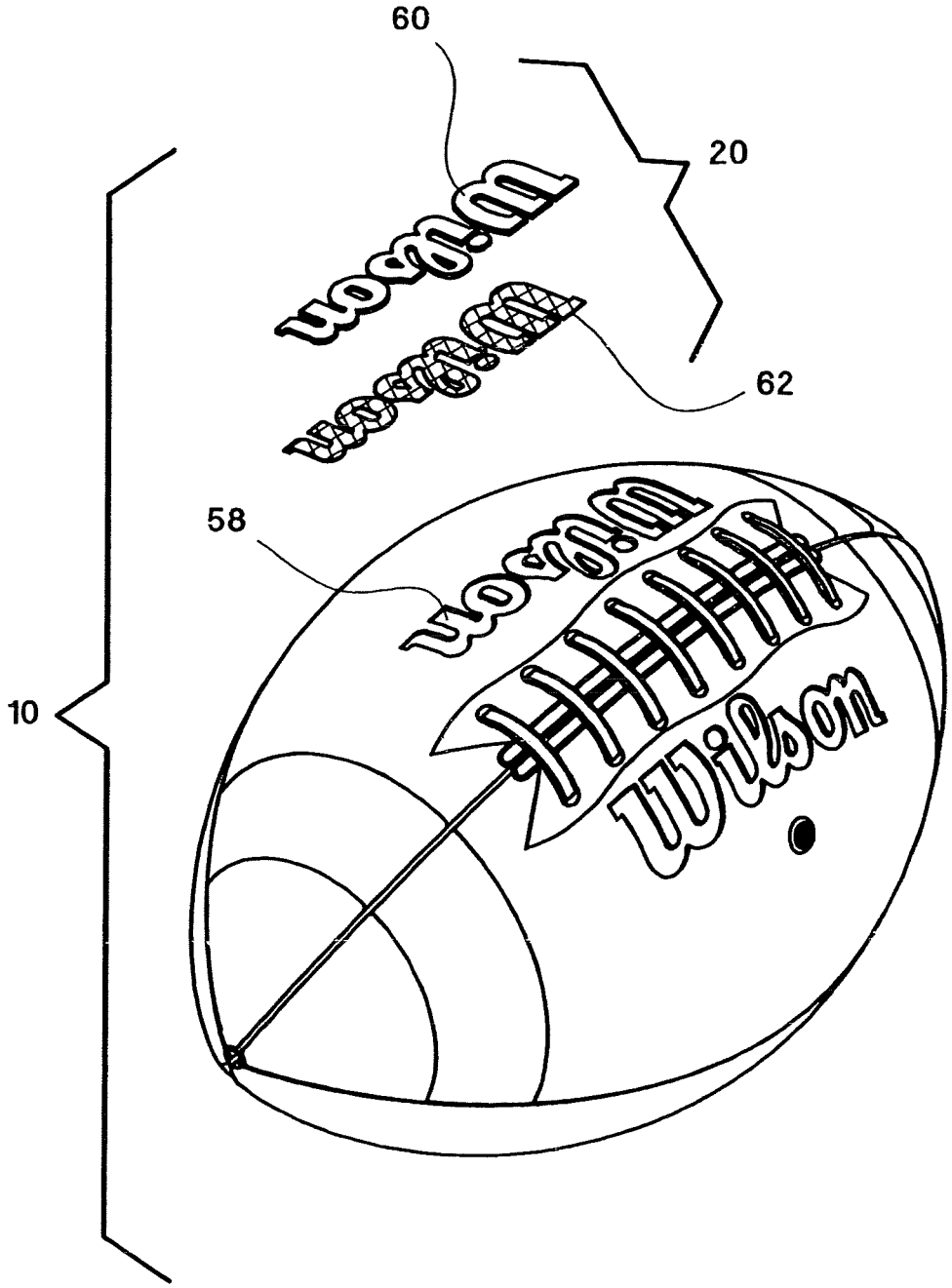
FIG. 9 is a top, partially exploded, perspective view of the football of FIG. 1.
Figure 10:
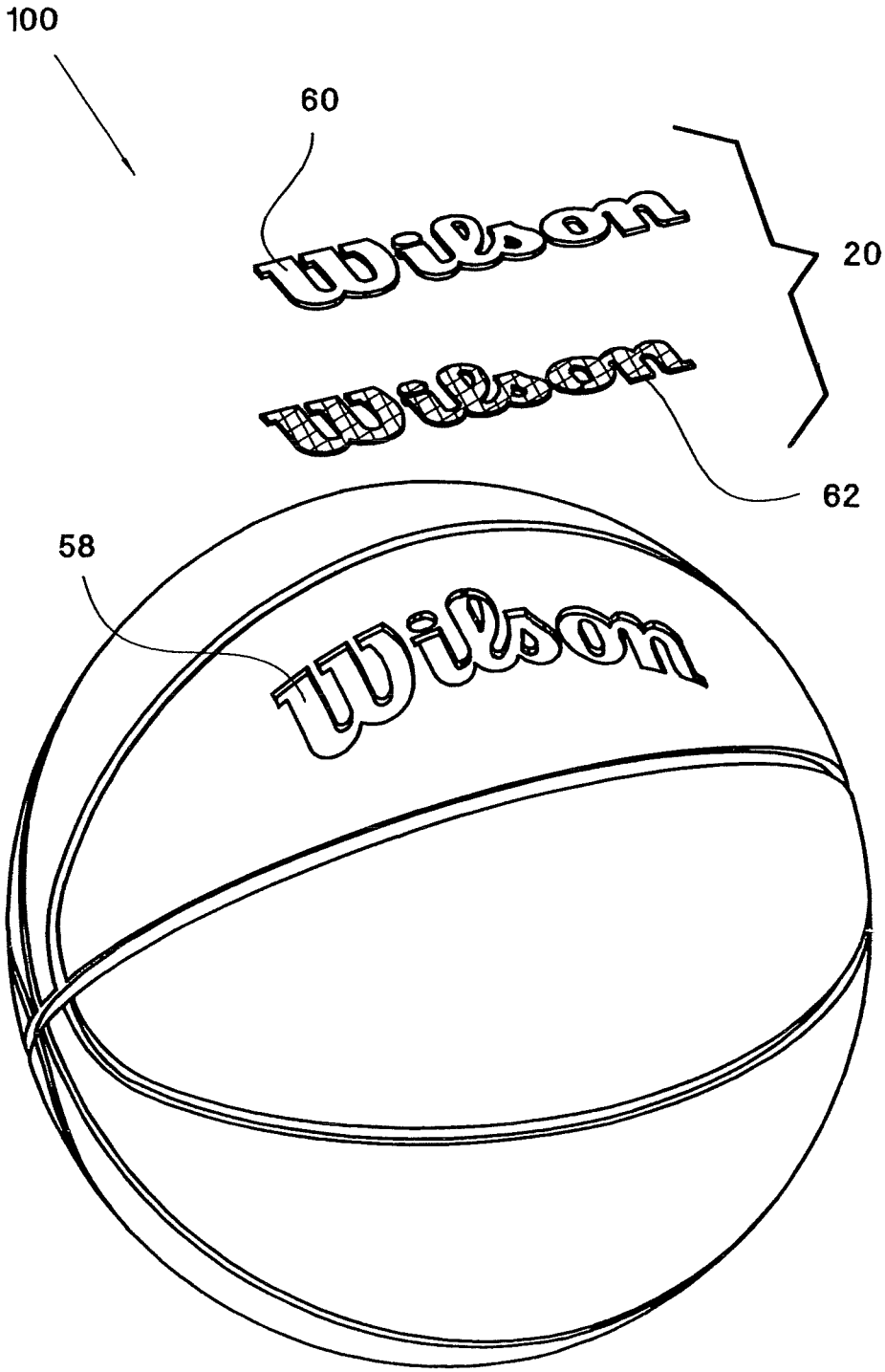
FIG. 10 is a partially exploded, perspective view of a basketball in accordance with another preferred embodiment of the present invention.

Referring to FIGS. 9 and 10, the present invention is also applicable to logos, trademarks or symbols applied to a game ball, such as, for example, the "Wilson" logo and trademark 20. The game ball can be a football, a basketball or any other type of game ball. In a preferred embodiment, the cover 12 includes a logo recess 58. The logo recess 58 is produced and has similar depth limitations as the stripe recesses 36, 38, 40 and 42 described above. The logo recess 58 is positioned at a desired position(s) on the cover 12 and is formed to generally correspond to the shape of the logo 20 or any other desired logo, trademark or symbol.

The logo 20 is preferably similar to the stripe 18 discussed above. In a preferred embodiment the logo 20 includes outer and inner portions 60 and 62, which are similar in construction and operation to the outer and inner portions 44 and 46 of the stripe 18. The logo 20 can be single or multi-colored, and can be representative of any alpha-numeric or graphical image. The outer surface of the outer portion 60 of the logo 20 can be smooth, pebbled or have other types of three dimensional outer surface configuration. The logo 20 is preferably connected to the cover 12 at the secondary recess 58 in a manner similar to the connection of the stripe 18 to the stripe recess 42.

The game ball 10 can be formed by first obtaining the cover 12 formed of one or more cover panels. The stripe recesses 42 and/or logo recesses 58 are then formed into the outer surface of the cover or cover panel. In a preferred embodiment, the recesses 42 and 58 are formed by embossing or pressing the outer surface of the cover. The cover or cover panel may have a pebbled texture before the formation of the recesses through embossing or pressing. In alternative preferred embodiments, the recesses 42 and 58 can be formed by milling, stripping or other conventional means for removing material. The stripe 18 and/or logo 20 is laid-in to the corresponding recess 42 or 58 and secured through adhesive bonding, thermal bonding, chemical bonding, stitching, sewing, press-fitting and combinations thereof. If the cover 12 is formed of two or more cover panels, the cover panels can be connected together through stitching or other means, and the cover is then positioned about the carcass.

The outer portion 44 of the stripe 18, and/or the outer portion 60 of the logo 20, is formed of a material that has a higher static coefficient of friction than the static coefficient of friction of the material used to form the outer surface of the cover 12, or the cover panels. The static coefficient of friction is measured in accordance with ASTM Standard D 1894-01 entitled "Standard Test Method for Static and Kinetic Coefficients of Friction of Plastic Film and Sheeting" promulgated by ASTM International located at 100 Barr Harbor Drive, West Conshohocken, Pa. 19428-2959.

In accordance with ASTM Std. D 1894-01, material samples are preferably trimmed to 2.5" width.times.2.5" length. A metal sled is used having a size of approximately 2.5' length.times.2.5' width.times.0.25' thickness. The bottom of the sled is lined with a high density foam (having a nominal density of 0.25 g/cm.sup.3). Prior to testing, the sled is weighed. A plane or runway is also used and placed onto a smooth supporting base. The runway is formed of a metal. In one example, the runway is formed of 304 Stainless Steel having a #8 Mirror Surface. The runway is cleaned with isopropyl alcohol and dried with a soft, lint-free cloth. The sample to be tested is attached to the sled. The sled is pulled across the runway at a speed of 152.4 mm per minute for a total distance of 200 mm. The initial force to start sled movement and the average force from the 25 mm distance to the 175 mm distance is recorded. The force measuring device is capable of measuring frictional force to +/−5% of its value, and can be a spring gage, a universal testing machine, or a strain gage. The sled weight is then divided into the force values (force values divided by the sled weight) to obtain the Static and Kinetic Coefficient of Friction values at the respective sled positions. Five specimens are tested for each material.

In a preferred embodiment, the static coefficient of friction of the material used to form the outer surface of the game ball, such as the football 10, is less or lower than the static coefficient of friction of the material used to form the outer surface of the stripe 18 and/or the logo 20. In a preferred embodiment, the static coefficient of friction of the material used to form the outer surface of the game ball, such as the football 10, is equal to or less than 0.50, and the static coefficient of friction of the material used to form the outer surface of the stripe 18 and/or logo 20 is greater than 0.50. In other alternative preferred embodiments, the static coefficient of friction of the material used to form the outer surface of the stripe 18 and/or the logo 20 is greater than 1.0, greater than 2.0, greater than 3.0, or greater than 3.5. In another alternative preferred embodiment, the static coefficient of friction of the material used to form the outer surface of the football 10, is equal to or less than 1.00, and the static coefficient of friction of the material used to form the outer surface of the stripe 18 and/or logo 20 is greater than 1.00.

In an independent test, Applicants obtained static coefficient of friction values for a variety of materials in accordance with ASTM Standard No. D 1894-01, and as described above. The materials tested included a white single tone polyurethane ("PU") material used to form stripes and/or logos on a football; a brown dual-tone PU material used to form part or all of the outer surface of a football; pieces of genuine leather used to form the cover or cover panels of a leather football; representative specimens of a Velcro® loop material; representative specimens of a Velcro® hook material; and a smooth plate of glass.

The results identified from testing the static coefficient of friction of five specimens of each of the above listed materials in accordance with ASTM D 1894-01 are shown below.

TABLE 1

STATIC COEFFICIENT OF FRICTION

| Sample No. | White PU Material | Brown PU Material | Genuine Leather | Velcro ® Hook Material | Velcro ® Loop Material | Smooth Plate of Glass |
|---|---|---|---|---|---|---|
| 1 | 3.57 | 3.20 | 0.39 | 0.14 | 0.19 | 0.15 |
| 2 | 4.22 | 3.43 | 0.36 | 0.12 | 0.18 | 0.16 |
| 3 | 4.43 | 3.28 | 0.40 | 0.12 | 0.18 | 0.16 |
| 4 | 3.95 | 3.35 | 0.40 | 0.13 | 0.17 | 0.16 |
| 5 | 3.95 | 4.13 | 0.39 | 0.12 | 0.18 | 0.17 |
| Avg. | 4.02 | 3.48 | 0.39 | 0.13 | 0.18 | 0.16 |
| Std. Dev. | 0.32 | 0.37 | 0.02 | 0.01 | 0.00 | 0.01 |

The white PU material is an example of the type of material that can be used under the present invention to form the outer surface of the stripe 18 and/or logo 20. Alternatively, the brown PU material can also be used to form the outer surface of the stripe 18 and/or the logo 20. Alternatively, other materials can also be used, such as, for example, a polyvinylchloride, a rubber, a leather, a synthetic leather, an elastomer and combinations thereof. The static coefficient of friction of such materials can vary, and can fall within the range of 0.40 to 5.0 or higher provided that the static coefficient of friction of the material used to form the outer surface of the stripe 18 or the logo 20 is higher than the static coefficient of friction used to form the outer surface of the game ball.

The genuine leather specimens listed in Table 1 were the same leather that is used to produce the covers of leather footballs. It is important to note that the leather on leather footballs typically becomes more grippable over time as the leather is used and breaks in. Accordingly, the static coefficient of friction value of genuine leather is anticipated to increase over time as the material is used. In contrast, the static coefficient of friction other materials, such as the hook and loop materials is not expected to increase over time or use.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. An inflatable American football having a major longitudinal dimension and a minor transverse dimension, the football configured for direct contact with a user's hands, the football comprising:

a cover including a plurality of cover panels, the cover panels having an outer surface formed of a first material, at least one of the cover panels being formed of at least first, second and third sub-panels; and at least first and second flexible, transversely extending stripes, each of the stripes including side edges, one of the side edges of the first stripe being fixedly coupled to the first sub-panel and the other of the side edges of the first stripe being fixedly coupled to the second sub-panel, one of the side edges of the second stripe being fixedly coupled to the second sub-panel and the other of the side edges of the second stripe being fixedly coupled to the third sub-panel, the at least first and second stripes having an outer surface formed of a second material, the second material having a static coefficient of friction that is greater than the static coefficient of friction of the first material when measured in accordance with the standard test method for static coefficient of friction of ASTM D1894-01, the at least first and second stripes not fully overlapping the at least one cover panel, the second material being a non-hook and/or loop material.

2. The football of claim 1, wherein the frictional interaction between the outer surface of the at least one of the stripes and the hands of the user is greater than the frictional interaction between the outer surface of the cover and the hands of the user.

3. The football of claim 1, wherein one of the side edges of the first stripe is stitched to the first sub-panel.

4. The football of claim 3, wherein the other of the side edges of the first stripe is stitched to the second sub-panel.

5. The football of claim 1, further comprising a bladder and a lining positioned over the bladder.

6. The football of claim 1, wherein the side edges of the first stripe are fixedly and non-removably coupled to the first and second sub-panels in a manner selected from the group consisting of adhesive bonding, thermal bonding, chemical bonding, stitching, sewing, press-fitting and combinations thereof.

7. The football of claim 1, wherein the static coefficient of friction of the second material used to form the outer surface of the at least one of the stripes is greater than or equal to 1.0.

8. The football of claim 1, wherein the outer surface of the at least one of the stripes includes an exposed surface having a pebbled texture.

9. The football of claim 1, wherein the cover includes at least first, second, third and fourth cover panels, wherein the at least first and second stripes include first, second, third and fourth stripes, wherein the first and second stripes are coupled to the first panel, and wherein the third and fourth stripes are coupled to the second cover panel.

10. The football of claim 9, wherein each of the first, second, third and fourth stripes transversely extend over at least a quarter of the circumference of the football.

11. The football of claim 1, wherein the static coefficient of friction of the second material is equal to or greater than 0.50 and the first material has a static coefficient of friction that is less than 0.50.

12. The football of claim 1, wherein the static coefficient of friction of the second material used to form the outer surface of the at least one of the stripes is greater than or equal to 2.0.

13. The football of claim 1, wherein the static coefficient of friction of the second material is equal to or greater than 1.0 and the first material has a static coefficient of friction that is less than 1.0.

14. The football of claim 1, wherein the at least one of the stripes has a thickness between the range of 0.2 to 2.0 millimeters.

15. The football of claim 1, wherein the second material of the at least one of the stripes is selected from a group consisting of a polyurethane, a polyvinylchloride, a rubber, a leather, a synthetic leather, an elastomer and combinations thereof.

16. The football of claim 1, wherein at least one of the stripes has an inner portion, and wherein the inner portion includes a backing layer.

17. The football of claim 1, further comprising a lacing, and wherein the lacing is longitudinally spaced apart from the first and second stripes.

18. The football of claim 1, wherein at least one of the first and second stripes is multi-layered.

19. The football of claim 18, wherein the at least one multilayered stripe includes an outer portion and an inner portion, wherein the inner and outer portions of the stripe are separated by an intermediate layer.

20. The football of claim 1, wherein the plurality of cover panels form longitudinal seams, wherein at least one of the first and second stripes is stitched at each end adjacent to respective longitudinal seams.

* * * * *